United States Patent [19]

Wittnebert

[11] 3,957,379

[45] May 18, 1976

[54] FOUNTAIN PEN

[75] Inventor: Frederick R. Wittnebert, Whitewater, Wis.

[73] Assignee: The Parker Pen Company, Janesville, Wis.

[22] Filed: Apr. 4, 1975

[21] Appl. No.: 565,296

[52] U.S. Cl. ..... 401/239

[51] Int. Cl.[2] ..... B43K 5/18

[58] Field of Search ..... 401/221–242, 401/248–250, 251

[56] References Cited

UNITED STATES PATENTS

| | | | |
|---|---|---|---|
| 495,238 | 4/1893 | Woolfolk | 401/225 |
| 495,647 | 4/1893 | Woolfolk | 401/225 |
| 734,563 | 7/1903 | Kegrize | 401/239 |
| 940,509 | 11/1909 | Cameron | 401/250 X |
| 2,019,734 | 11/1935 | Sager | 401/225 X |
| 2,455,964 | 12/1948 | Winter | 401/239 X |
| 2,483,603 | 10/1949 | Wing | 401/226 |
| 2,937,618 | 5/1960 | Ribas | 401/248 X |

FOREIGN PATENTS OR APPLICATIONS

| | | | |
|---|---|---|---|
| 270,915 | 5/1927 | United Kingdom | 401/251 |

*Primary Examiner*—Lawrence Charles

[57] ABSTRACT

A fountain pen comprising a multipurpose writing nib having a contoured paper contacting portion or pellet attached to a forward portion thereof and two opposed, generally flat faces, each face being distinctly supported against flexure for providing variations in writing line breadth from using one or the other face of the nib against a writing surface.

5 Claims, 7 Drawing Figures

FOUNTAIN PEN

BACKGROUND OF THE INVENTION

This invention generally relates to writing pens and more particularly to improved nib means for providing selective writing line widths.

Most commonly distributed fountain pens comprise writing nibs which provide writing having only one preselected line width. If a different line width is desired another nib laying down such different line width must be assembled into the pen or two pens must be used. Frequently individuals, such as accountants, desire to make inscriptions of at least two widths during one recording operation; a relatively fine line is desirable when ledger insertions are being made and a relatively wider line being useful for other general notemaking and for signatures. At the present time two writing instruments are required in such a situation, each writing lines of distinct width. The disadvantages of using two pens are overcome when a single nib has the ability to write lines of two distinct widths with equal ease and exactness. Thus lines of two writing characteristics can be effected in an easy and smooth manner without major disturbance to the writer simply by rotating the pen.

SUMMARY OF THE INVENTION

It is a principal object of this invention to provide a simple and efficient nib assembly for a fountain pen.

A further object of this invention is to provide improved means for readily writing lines of two distinct widths.

Yet another object of this invention is to provide a nib affording considerable advantages over known constructions.

It is also an object of this invention to provide an improved pen nib having a plurality of paper-contacting portions whereby rotation of the nib produces lines of different width and character.

A still further object of this invention is to provide a simple and efficient writing implement, readily constructed and assembled yet providing an effective means for allowing a writer to choose and alter his writing stroke.

A feature of this invention is to provide a nib having a contoured pellet cooperating with improved supporting means for freely laying down lines of different widths depending upon which side of the nib faces the writing surface.

Another object of this invention is to provide a pen nib which combines simplicity and durability in construction with ease, convenience and efficiency in operation.

Further objects and features as well as advantages of this invention will become apparent as the following description of an illustrated embodiment thereof proceeds and is given for the purpose of disclosure and is taken in conjunction with the accompanying drawings in which like character references designate like parts throughout the several views.

DETAILED DESCRIPTION

Figure 1:
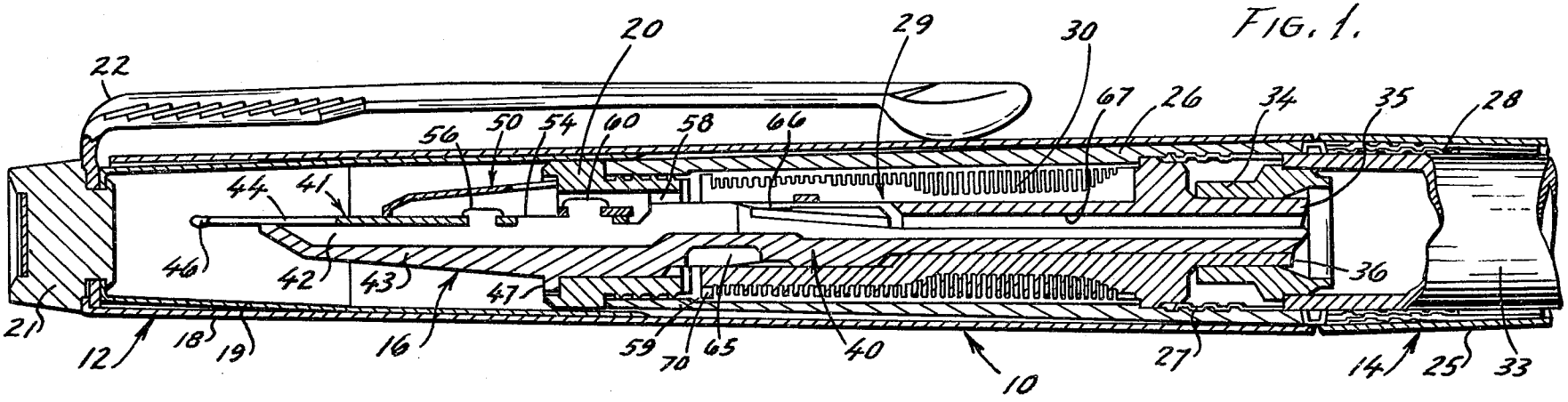
FIGS. 1 and 1*a* are a broken, vertical sectional view through a fountain pen incorporating the principles of this invention.
Figure 1A:
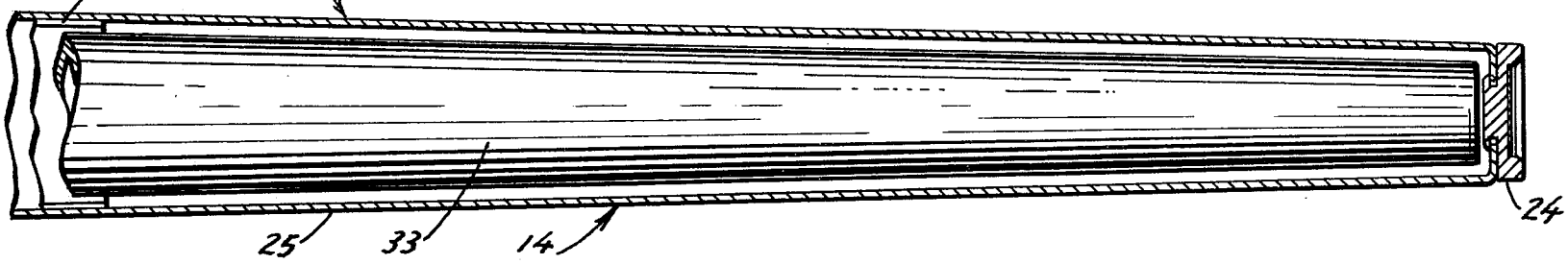
Figure 5:
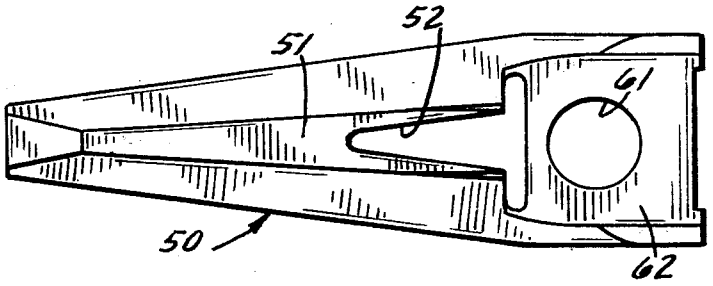
FIG. 5 is an enlarged top plan view of a nib retainer incorporating the principles of this invention.

Referring now to the several figures and first to FIG. 1 there is shown a complete fountain pen 10 which includes a cap assembly 12 covering a writing end of the pen; the cap assembly is shown connected to a barrel assembly 14 but is removable therefrom for writing with the pen. A nib and feed assembly 16 comprising this invention is shown at the writing end of the pen.

The cap assembly 12 includes an outer, open-ended, generally cylindrically-shaped shell 18 formed of a metal, such as stainless steel, or some other suitable material. The shell 18 contains a tubular inner cap 19 which is internally proportioned to snugly receive a nib collar 20 at the writing end of the writing instrument for holding the cap assembly 12 and barrel assembly 14 together at such times when the pen is not being used, such as when it is being carried in a pocket or purse and it is desired to cover or protect the writing end of the pen. A clip rivet is fixed to the inner cap 19 for attaching a clip 22 to the cap assembly and for holding the shell 18 and inner cap 19 together.

The barrel assembly includes a generally open-ended barrel 25 formed of a metal, such as stainless steel, or some other suitable material. The barrel 25 connects to a generally tubular collector shell 26 by a shell connector 27. The inner wall of the collector shell 26 is proportioned to receive one end of the shell connector 27 and a suitable cement is used to bond the shell and connector together. The other end of the shell connector 27 is threaded to engage in a threaded end of a cylindrical barrel connector 28 which is cemented interiorally of one end of the barrel 25. In this manner, when the threaded portions of the barrel connector 28 and the shell connector 27 are connected, the barrel 25 is removably joined to the collector shell 26. A barrel tassie 24 is riveted across the other end of the barrel 25 for closing that end of the barrel.

Fitted within the collector shell 26 and held in place by ultrasonic bonding is a collector 29 having a number of radial fins 30 forming therebetween a number of capillary ink storage cells for receiving and thereafter feeding out any excess ink which may collect therein. The nib collar 20 is cemented into the collector shell 26 for connecting the cap assembly 12 and the barrel assembly 14 as hereinbefore described.

The inner dimensions of the barrel 25 are proportioned to receive and hold a replaceable ink reservoir or cartridge 33. It should be understood that the barrel 25 is adapted to receive a similarly, externally configured refillable ink reservoir (not shown). A collar 34 forms one end wall of the reservoir 33. To accomplish the mounting and connection of the reservoir 33 to the collector 29, the collector includes a centrally disposed, axially extending tubular portion having a rearward end 36 oriented at an angle to the axis of the pen for providing a sharp, knifelike surface to cut through the collar 34 which after being penetrated by the tubular portion 35 fits snugly around and over the tubular portion 35 preventing escape of ink from the reservoir along the outside wall of portion 35 yet providing communication wih the ink supply in the reservoir 33.

Figure 3:
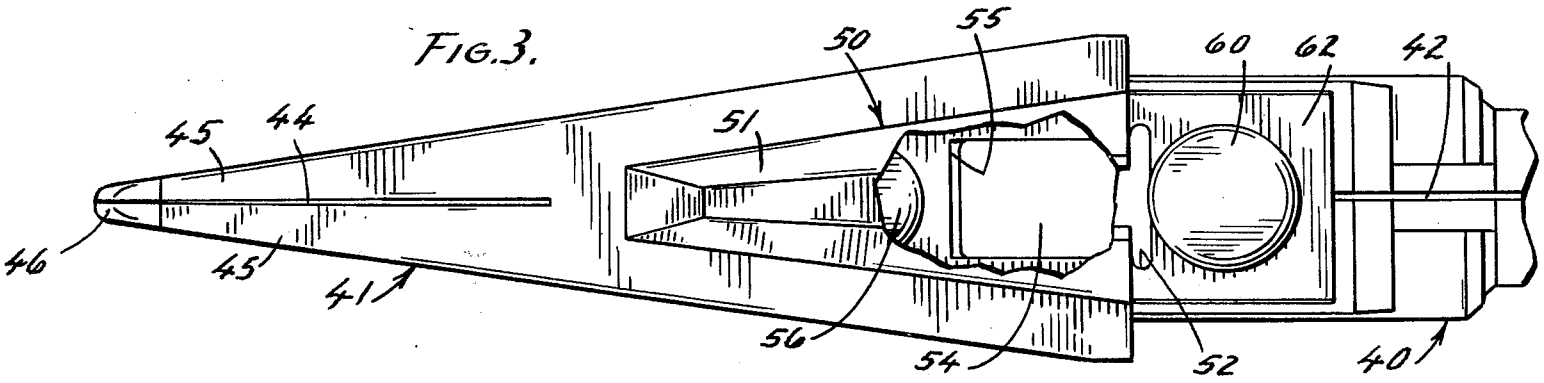
FIG. 3 is a foreshortened top plan view, partially broken away of the nib and feed assembly shown in FIG. 2.

The collector 29 and nib collar 20 have aligned, centrally located bores therethrough which are proportioned to receive a feed 40 that serves to mount a nib 41 in the pen and to couple the nib to the ink supply contained in the reservoir 33 as well as to provide passage of replacement air from the atmosphere into the reservoir 33 as the ink supply is used up. The feed includes a collar 47 which stops the nib and feed assembly 16 against a shoulder formed internally of the nib collar 20 for exactly aligning the assembly 16 with respect to the collector 29. It should be pointed out that no rotational alignment is necessary because no radial orientation is necessary inside the collector. The nib and feed assembly 16 is freely rotatable within the collector bore and it will operatively function from any radial position therewithin. The feed 40 includes a longitudinally extending capillary feed groove 42 (FIG. 3) along which the ink flows from the reservoir 33 to the nib 41 and above which, in a space between the feed and the bore through the nib collar 20 and collector 29, replacement air flows into the cartridge. The feed 40 includes a tapered portion 43 at its front end which underlies the nib 41 and extends outwardly from the nib collar when the nib and feed assembly 16 is operatively assembled in the nib collar and collector bores. The tapered portion 43 becomes gradually less wide and less high as it approaches the writing end of the pen. The feed groove 42 in the feed 40 extends into the tapered portion 43 thereof for carrying ink to a slit 44 formed in the nib 41. The slit 44 defines a pair of adjacent, juxtaposed nib tines 45 having a pellet 46 attached to their outer ends. The slit 44 continues through the pellet for laying down ink on a writing surface. Looking toward the pellet 46, as in FIG. 4, it is shown that the pellet is substantially oval or egg-shaped with the larger or broader portion thereof being on the side of the nib toward the tapered portion 43 of the feed 40. A nib having a pellet configured in this manner can provide two distinct types of writing with the broader portion producing a broader line or stroke than the narrower portion of the pellet which is positioned toward the top of the nib. It should be understood that the sides of the pellet are not usually used in writing operations because they have no feed slit associated therewith for laying down ink on a writing surface.

A nib retainer 50 overlies the top of the nib 41. The external appearance of the exposed portion of the nib retainer 50 is similar to that of the exposed end of the feed in that it includes a tapered portion 51 which overlies the nib 41 and extends outwardly from the nib collar 20 when the nib 41, feed 40 and nib retainer 50 are operatively assembled into the writing end of the pen. The tapered portion 51 of the nib retainer 50 becomes gradually less wide and less high toward its free end. The tapered portion 51 of the nib retainer 50 is hollow and includes a T-shaped slot which provides communication between the atmosphere and the hollow interior of retainer 50.

The top of the feed 40 includes a raised rectangular nib lock lug 54 which fits through a rectangular hole 55 in the nib to position the nib on the feed and a raised post 56 which fits through an associated circular hole in the nib; said post 56 being suitably deformed or mushroomed over to lock the nib to the feed. The mushroomed post 56 prevents the nib from moving away from the feed when the force of writing pressure is exerted against the nib from the side of the nib adjacent the feed. The nib lock lug 54 has a post 60 extending therefrom which fits through an associated circular hole 61 formed in a relatively flat tail portion 62 of the retainer 50. The post 60 is suitably deformed or mushroomed to lock the nib retainer to the nib and feed.

The feed 40 also includes a plurality of circumferentially positioned, externally extending lugs 48 (one shown in FIG. 2) which provide a tight pressure fitting for the nib and feed assembly 16 against an inner circumferential wall of the nib collar 20. These lugs 48 also cooperate with the tail portion 62 of the nib retainer 50 for providing this snug fit.

Figure 2:
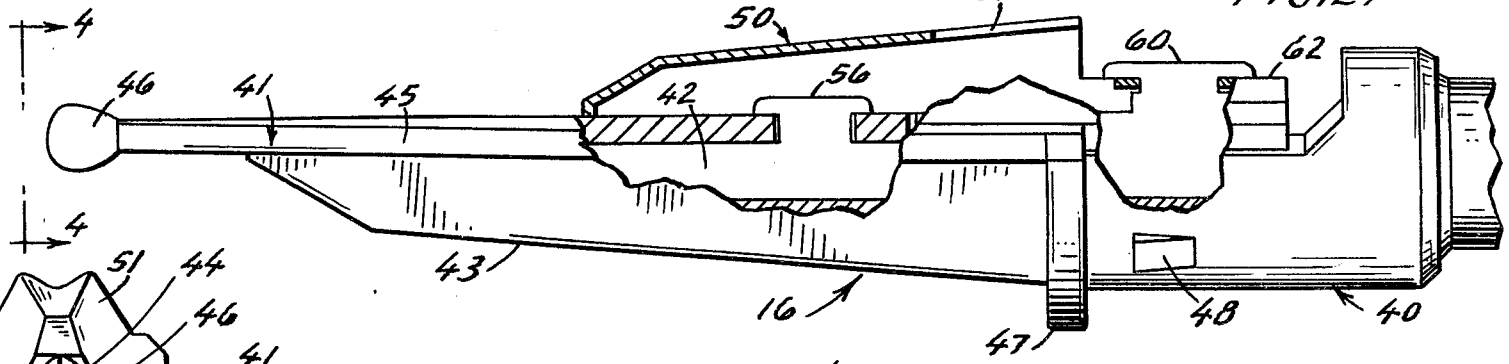
FIGS. 2 and 2*a* are a broken, enlarged elevational view partially broken away and having a portion removed therefrom of a nib and feed assembly incorporating the principles of this invention.
Figure 2A:
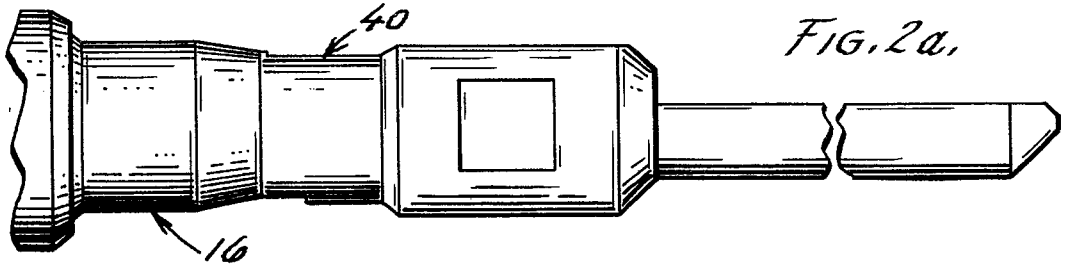
Figure 4:
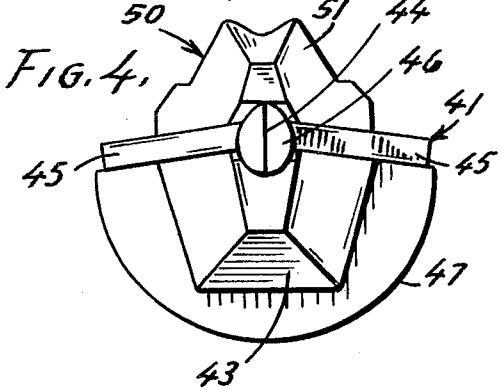
FIG. 4 is an end view taken along the line 4—4 of FIG. 2 looking in the direction indicated by the arrows.

The nib 41 is generally flat-appearing, however, as best seen in FIG. 4 the nib tines 45 are two planes which extend away from the horizontal approximately 8° thereby forming an approximately 164° included angle on the side of the nib toward the broader portion of the pellet. During a writing operation when the broader portion of the pellet touches the paper, a wider, wetter line is provided because the force acting against the broad portion of the pellet and the 8° orientation of the tines results in vector forces tending to force the tines apart and force open the slit; when the pen is rotated and the narrower portion of the pellet touches the paper, a finer, drier line is laid down, because the writing force acting against the narrow portion of the pellet and the 8° orientation of the tines results in vector forces tending to urge the tines together thereby reducing the width of the slit between the tines. As best seen in FIGS. 1 and 2 the free end of the nib retainer 50 is further away from the pellet of the nib than is the free end of the feed 40. Thus the fulcrum provided against the bending of the nib toward either the retainer 50 or the feed 40 is differently located. In that way a force applied against the broad portion of the pellet would meet less resistance to bending of the nib than an equal force applied against the narrower portion of the pellet.

As mentioned before, the nib retainer 50 is effectively hollow and includes the T-shaped slot 52 which forms the outside entrance for getting atmospheric air into the reservoir 33 to replace the ink therefrom which is written out during the writing process. In operation the air enters through T-shaped slot 52 and enters the hollow interior of nib retainer 50. From here the air passes around the post 60 between the retainer and the nib and then through a notch 58 in the feed. From the notch 58 the air enters and flows around a circumferential void 59 which is effectively a space between the front end of the collector 29 and the inner end of the nib collar 20. The circumferential void communicates with a notch 65 in the underside of the feed. It is appropriate to point out here that the notch 65 is normally full of air. The notch communicates with a wier 66 which is a circumferential space between the feed 40 and the internal bore through the collector 29. The wier 66 is normally full of ink, however when it is necessary to equalize the pressure in the reservoir, the air in the notch 65 passes around the wier 66 from bottom to top and then passes along a channel 67 above the feed into the reservoir. The circumferential void 59 also communicates with the spaces between the collector fins through a notch 70. The fins of the collector are normally full of air, that is, empty of ink, but if the collector is required to temporarily store a supply of ink, the air from the collector has egress to the atmosphere through the notch 70, into circumferential void 59 and through notch 58 into the interior of retainer 50 and out of slot 52.

Thus, it will be appreciated that all of the recited objects, advantages and features of the present invention have been demonstrated as obtainable in a highly practical fountain pen and one that is not only simple and positive in operation, but one that is relatively inexpensive and easy to manufacture.

It will be further understood that although this invention has been described with respect to certain specific embodiments thereof, it is not limited thereto, because various modifications of said invention will suggest themselves from the aforesaid description and one intended to be encompassed within the scope of the appended claims wherein there is claimed:

1. A writing pen unit comprising a substantially flat nib including resilient tines spaced by a capillary slit having a closed end and an open end, a first nib hole, and a second nib hole;

a tapered feed support underlying the nib and including a post extending through the first nib hole, said post being mushroomed over the nib for securely attaching the support to the underside of the nib, the support further including a lock lug extending through the second nib hole and the lug having a deformable post extending therefrom;

a nib retainer overlying and bearing on the nib, said nib retainer having a hollowed recess facing said nib and having an opening for movement of air into the recess and a hole receiving therethrough the lock lug post, said post being mushroomed over the nib retainer for locking the nib retainer, nib and feed support together into a unit; and means on said support for connecting said unit to a pen reservoir.

2. A writing pen as claimed in claim 1 wherein a substantially oval-shaped, slit pellet is carried by the tines at the open end of the slit and said pellet having its broader portion positioned on the underside of the nib.

3. A writing pen as claimed in claim 2 wherein the forward end of the feed support is closer to the pellet than the forward end of the nib retainer permitting greater flexing of the nib toward the retainer than toward the feed support.

4. A writing pen as claimed in claim 3 wherein each tine slopes 8° away from a horizontal plane and toward the feed support.

5. A nib assembly as claimed in claim 4 wherein a larger end of the contoured pellet is positioned facing the side of the nib having the included angle.

* * * * *